US005722577A

United States Patent [19]

Simpson

[11] Patent Number: 5,722,577

[45] Date of Patent: Mar. 3, 1998

[54] DRAGBOARD ASSEMBLY

[75] Inventor: Lloyd Simpson, Pittsburgh, Pa.

[73] Assignee: Armstrong/Kover Kwick, Inc., McKees Rocks, Pa.

[21] Appl. No.: 508,177

[22] Filed: Jul. 27, 1995

[51] Int. Cl.[6] ..... B65H 23/00

[52] U.S. Cl. ..... 226/195

[58] Field of Search ..... 226/195, 196; 242/419.4, 548, 615.4

[56] References Cited

U.S. PATENT DOCUMENTS

| | | | |
|---|---|---|---|
| 3,058,376 | 10/1962 | Fry . | |
| 3,071,032 | 1/1963 | Teplitz . | |
| 3,446,052 | 5/1969 | Oakes et al. | 72/250 |
| 3,555,873 | 1/1971 | Oakes et al. . | |
| 3,559,862 | 2/1971 | Jablin et al. | 226/195 |
| 3,672,595 | 6/1972 | Jablin et al. . | |
| 3,863,858 | 2/1975 | Cauffiel et al. . | |
| 3,950,988 | 4/1976 | Nowisch et al. . | |
| 4,215,806 | 8/1980 | Holmstrom . | |
| 4,298,633 | 11/1981 | Bradlee . | |
| 4,347,723 | 9/1982 | Bradlee . | |
| 4,922,361 | 5/1990 | Bordignon | 226/196 |

*Primary Examiner*—Daniel P. Stodola
*Assistant Examiner*—Matthew A. Kaness
*Attorney, Agent, or Firm*—Webb Ziesenheim Bruening Logsdon Orkin & Hanson, P.C.

[57] ABSTRACT

A dragboard for use in wiping or tensioning of a continuous metal strip utilizing a protective layer which is formed to encapsulate a substrate. A contact layer is attached to the protective layer through an adhering layer. The protective layer is removeably attached to the substrate permitting replacement of the protective layer.

7 Claims, 1 Drawing Sheet

DRAGBOARD ASSEMBLY

BACKGROUND OF THE INVENTION

1. Field of the Invention

The present invention relates to a dragboard for use on a coil processing line for wiping or tensioning a continuous process metal strip.

2. Description of the Prior Art

The steel industry commonly utilizes continuous processes for handling coiled material. As part of these processes, dragboards, also known as drag wipes, are frequently used to produce tension or to wipe the surface of the material. Examples of dragboards are shown in U.S. Pat. Nos. 3,446,052; 3,559,862; and 3,672,595.

A majority of dragboards utilize a wooden substrate having an attached felt-like contact surface. Simple attachment of the felt surface by stapling was improved upon through the use of a hook attachment layer bonded to the wooden substrate. This provided the advantage of easy replacement of the felt contact layer. However, because dragboards often encounter harsh environments, including oils and other contaminants, surface treatments, involving extensive material and labor costs, were required to be applied to the wooden substrate to prolong the life of the dragboard. Even with these treatments, however, contamination combined with contact damages, such as gouging, greatly shortened the life of the wooden dragboard. Typically, the dragboard is made of a hard wood and the diminishing availability and increased costs of hard wood make it imperative that the wood substrate be preserved.

SUMMARY OF THE INVENTION

The present invention involves the use of a protective layer which encapsulates the substrate. The use of a high density impact resistant plastic allows for heat-forming of the protective layer to accommodate nearly any cross-sectional shape desired. The use of the protective layer shields the substrate from both contaminant degradation and wearing-type damage, such as gouging. This will prolong the life of the substrate and potentially eliminate the need for the surface treatments. A hook type adhering layer attached to the protective layer provides for replaceability of a felt contact layer. The protective layer also may be removeably attached to the substrate allowing for replacement of the protective layer.

BRIEF DESCRIPTION OF THE PREFERRED EMBODIMENTS

Figure 1:
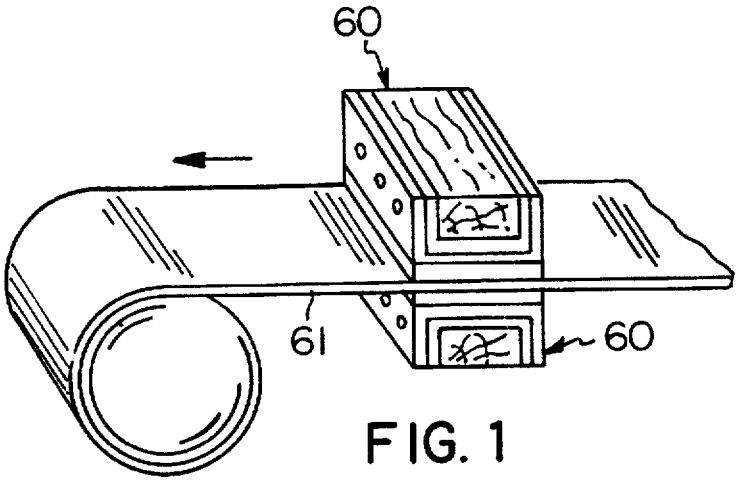
FIG. 1 is a perspective view of a portion of a continuous process utilizing the dragboard in accordance with a preferred embodiment of the invention.

Referring to the drawings, a representative application of a preferred embodiment is shown in FIG. 1 where a pair of dragboards 60 is wiping opposing surfaces of a continuous strip of material 61. Other applications include providing tension to portions of the strip on a processing line to facilitate handling.

Figure 4:
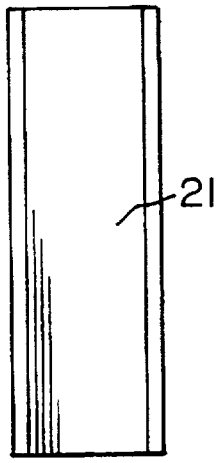
FIG. 4 is a bottom plan view of the protective cover.
Figure 2:
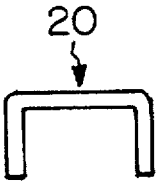
FIG. 2 is an end view of the protective cover.
Figure 3:
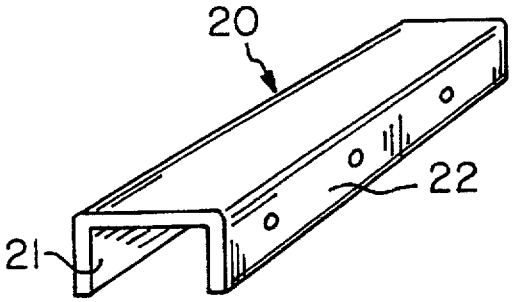
FIG. 3 is a perspective view of the protective cover.
Figure 6:
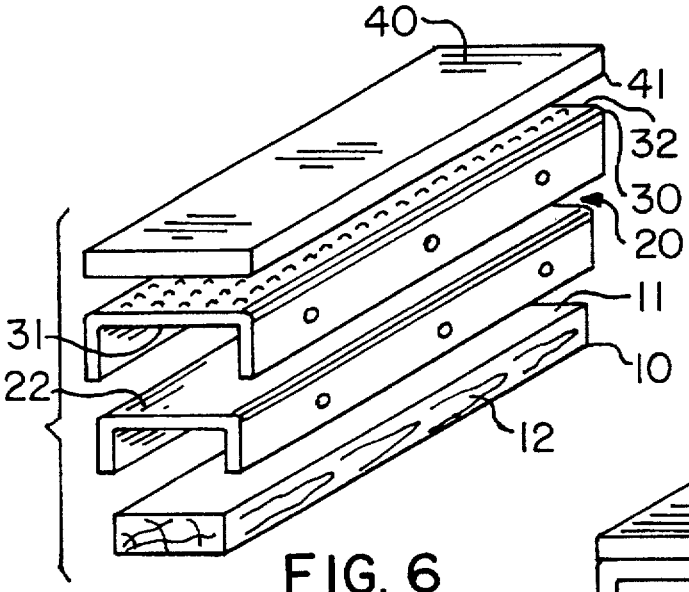
FIG. 6 is an exploded perspective view of the dragboard assembly.
Figure 5:
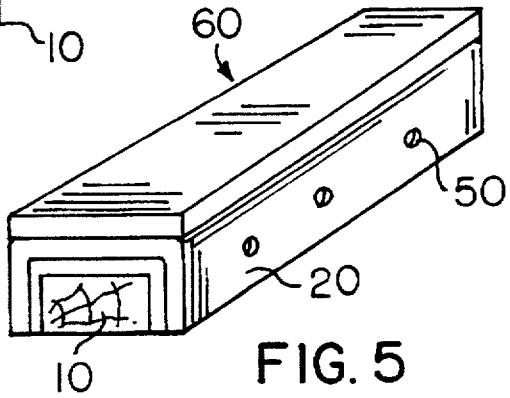
FIG. 5 is a perspective view of the dragboard assembly.

The dragboard assembly, shown in FIGS. 5 and 6, has a wooden substrate 10 having an upper surface 11 and side surfaces 12. Substrate 10 is shown as rectangular, but it will be recognized that other cross-sections can be equally embodied in the subject invention. A protective layer 20, having an inner surface 21 and an outer surface 22, covers the wooden substrate 10, FIGS. 3 and 5. In a preferred embodiment, the protective layer, shown in FIGS. 2–4, is a high density and high impact resistant heat-formed plastic whose inner surface 21 also covers the side surfaces 12 of the wooden substrate 10, and the protective layer 20 is removeably attached to at least one of the side surfaces 12 and preferably both side surfaces using a plurality of fasteners 50, thereby permitting replacement of the protective layer 20, FIG. 5.

Figure 7:
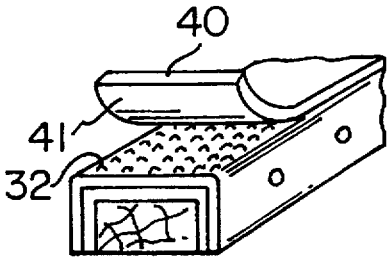
FIG. 7 is a perspective view showing the connecting surfaces between the contact layer and the adhering layer of the dragboard assembly.

An adhering layer 30 has a lower surface 31 which is attached to the outer surface 22 of the protective layer 20 through a conventional adhesive. A contact layer such as felt layer 40 has a lower surface 41 attached to an upper surface 32 of the adhering layer 30. In a preferred embodiment, the upper surface 32 of the adhering layer 30, which is sold by Aplix, Inc. under the name Mr. Blue, comprises a series of hooks, as shown in FIG. 7, which adhere to the lower surface 41 of the felt wiper 40.

The dragboard assembly is easily assembled and disassembled and the total life of the assembly is greatly enhanced by protecting the wooden substrate. This, in turn, reduces costs and helps preserve our natural resources.

Having described the presently preferred embodiments of my invention, it is to be understood that it may otherwise be embodied within the scope of the appended claims.

I claim:

1. A dragboard for use in a strip processing line comprising:

a. an elongated substrate having an upper surface, a lower surface and a pair of side surfaces;

b. a protective layer having an outer surface and an inner surface, the inner surface attached to, and covering, the upper surface and side surfaces of the substrate;

c. an adhering layer having an upper surface and a lower surface, with the upper surface of the adhering layer including a plurality of hooks and the lower surface of the adhering layer attached to the outer surface of the protective layer; and d. a contact layer having an upper surface and a lower surface, with the lower surface of the contact layer removeably attached to the upper surface of the adhering layer by the plurality of hooks.

2. The dragboard of claim 1, wherein the substrate is wooden.

3. The dragboard of claim 1, wherein the protective layer covers the side surfaces of the substrate and is removeably attached to at least one of the sides of the substrate permitting replacement of the protective layer.

4. The dragboard of claim 3, wherein the protective layer is a high density and high impact resistant heat-formed plastic.

5. The dragboard of claim 4, wherein the contact layer is felt.

6. In a dragboard having a substrate, an adhering layer carried on the substrate, and a contact layer for attachment to the adhering layer, the improvements comprising:

a. a protective layer located between the substrate and the adhering layer and covering a top surface and a pair of side surfaces of the substrate and removeably attached to at least one of the side surfaces of the substrate, wherein the contact layer is removeably attached to the adhering layer by a plurality of hooks disposed on the adhering layer.

7. A method of refurbishing a dragboard, which comprises the following steps:

a. removing a protective layer, an adhering layer and a felt layer from a substrate, wherein the felt layer is attached to the adhering layer by a plurality of hooks disposed on the adhering layer;

b. removing the felt layer from the adhering layer;

c. stripping the adhering layer from the protective layer;

d. attaching a new adhering layer to the protective layer;

e. attaching a new felt layer to the new adhering layer; and f. attaching the protective layer, carrying the new adhering layer and new felt layer, to the substrate.

* * * * *